US006180924B1

(12) United States Patent
Cummer

(10) Patent No.: US 6,180,924 B1
(45) Date of Patent: Jan. 30, 2001

(54) MORTAR COMPONENT MATERIALS CONDITIONING DEVICE

(76) Inventor: Thomas J. Cummer, 15589 Haberkorn Rd., Sherrill, IA (US) 52073

( * ) Notice: Under 35 U.S.C. 154(b), the term of this patent shall be extended for 0 days.

(21) Appl. No.: 09/466,089

(22) Filed: Dec. 17, 1999

(51) Int. Cl.[7] ..... B67D 5/62; F27D 11/00; F27D 15/00; H05B 3/30

(52) U.S. Cl. ..... 219/433; 219/429; 222/146.5

(58) Field of Search ..... 219/432, 433, 219/429; 222/146.5

(56) References Cited

U.S. PATENT DOCUMENTS 2,392,208 * 1/1946 Wilken ..... 219/433
3,199,136 * 8/1965 George ..... 219/433
3,313,919 * 4/1967 Richardson et al. ..... 219/433
3,896,973 * 7/1975 Morgan ..... 222/146.5
4,145,603 * 3/1979 Mackay et al. ..... 219/432
4,160,152 * 7/1979 Wightman et al. ..... 222/146.5
4,839,498 * 6/1989 Chak ..... 219/433
5,895,595 * 4/1999 Haden ..... 219/432
5,961,866 * 10/1999 Hansen ..... 219/433

* cited by examiner

*Primary Examiner*—Joseph Pelham

(57) ABSTRACT

A substance holding and heating apparatus for preventing sand and water from freezing. The substance holding and heating apparatus includes a rectangular base member which is essentially a housing, and also includes a substance holding member having side walls and being securely disposed upon the housing and extending upwardly therefrom, and further includes a lid member having a top wall and side walls extending downwardly from the edges of the top wall and further having a handle member securely attached to an exterior of the top wall with the lid member being closeable over the open top of the substance holding member, and also includes a heating element diposed inside the housing and beneath the substance holding member, a switch member connected to the heating element, and a power cord connected to the switch member and being adapted to plug into a power source.

8 Claims, 3 Drawing Sheets

MORTAR COMPONENT MATERIALS CONDITIONING DEVICE

BACKGROUND OF THE INVENTION

1. Field of the Invention

The present invention relates to a heat tank apparatus and more particularly pertains to a new substance holding and heating apparatus for preventing sand and water from freezing.

2. Description of the Prior Art

The use of heat tank apparatus is known in the prior art. More specifically, heat tank apparatus heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,193,906; U.S. Pat. No. 121,351; U.S. Pat. No. 1,875,516; U.S. Pat. No. 4,452,535; U.S. Pat. No. 277,277; and U.S. Pat. No. Des. 373,021.

While these devices fulfill their respective, particular objectives and requirements, the aforementioned patents do not disclose a new substance holding and heating apparatus. The inventive device includes a rectangular base member which is essentially a housing, and also includes a substance holding member having side walls and being securely disposed upon the housing and extending upwardly therefrom, and further includes a lid member having a top wall and side walls extending downwardly from the edges of the top wall and further having a handle member securely attached to an exterior of the top wall with the lid member being closeable over the open top of the substance holding member, and also includes a heating element diposed inside the housing and beneath the substance holding member, a switch member connected to the heating element, and a power cord connected to the switch member and being adapted to plug into a power source.

In these respects, the substance holding and heating apparatus according to the present invention substantially departs from the conventional concepts and designs of the prior art, and in so doing provides an apparatus primarily developed for the purpose of preventing sand and water from freezing.

SUMMARY OF THE INVENTION

In view of the foregoing disadvantages inherent in the known types of heat tank apparatus now present in the prior art, the present invention provides a new substance holding and heating apparatus construction wherein the same can be utilized for preventing sand and water from freezing.

The general purpose of the present invention, which will be described subsequently in greater detail, is to provide a new substance holding and heating apparatus which has many of the advantages of the heat tank apparatus mentioned heretofore and many novel features that result in a new substance holding and heating apparatus which is not anticipated, rendered obvious, suggested, or even implied by any of the prior art heat tank apparatus, either alone or in any combination thereof.

To attain this, the present invention generally comprises a rectangular base member which is essentially a housing, and also includes a substance holding member having side walls and being securely disposed upon the housing and extending upwardly therefrom, and further includes a lid member having a top wall and side walls extending downwardly from the edges of the top wall and further having a handle member securely attached to an exterior of the top wall with the lid member being closeable over the open top of the substance holding member, and also includes a heating element diposed inside the housing and beneath the substance holding member, a switch member connected to the heating element, and a power cord connected to the switch member and being adapted to plug into a power source.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new substance holding and heating apparatus which has many of the advantages of the heat tank apparatus mentioned heretofore and many novel features that result in a new substance holding and heating apparatus which is not anticipated, rendered obvious, suggested, or even implied by any of the prior art heat tank apparatus, either alone or in any combination thereof.

It is another object of the present invention to provide a new substance holding and heating apparatus which may be easily and efficiently manufactured and marketed.

It is a further object of the present invention to provide a new substance holding and heating apparatus which is of a durable and reliable construction.

An even further object of the present invention is to provide a new substance holding and heating apparatus which is susceptible of a low cost of manufacture with regard to both materials and labor, and which accordingly is then susceptible of low prices of sale to the consuming public, thereby making such substance holding and heating apparatus economically available to the buying public.

Still yet another object of the present invention is to provide a new substance holding and heating apparatus which provides in the apparatuses and methods of the prior art some of the advantages thereof, while simultaneously overcoming some of the disadvantages normally associated therewith.

Still another object of the present invention is to provide a new substance holding and heating apparatus for preventing sand and water from freezing.

Yet another object of the present invention is to provide a new substance holding and heating apparatus which includes a rectangular base member which is essentially a housing, and also includes a substance holding member having side walls and being securely disposed upon the housing and extending upwardly therefrom, and further includes a lid member having a top wall and side walls extending downwardly from the edges of the top wall and further having a handle member securely attached to an exterior of the top wall with the lid member being closeable over the open top of the substance holding member, and also includes a heating element diposed inside the housing and beneath the substance holding member, a switch member connected to the heating element, and a power cord connected to the switch member and being adapted to plug into a power source.

Still yet another object of the present invention is to provide a new substance holding and heating apparatus that allows the user to make mortar and do masonry work during the cold.

Even still another object of the present invention is to provide a new substance holding and heating apparatus that easily and conveniently allows the user to mix sand and water together to make mortar during the cold.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
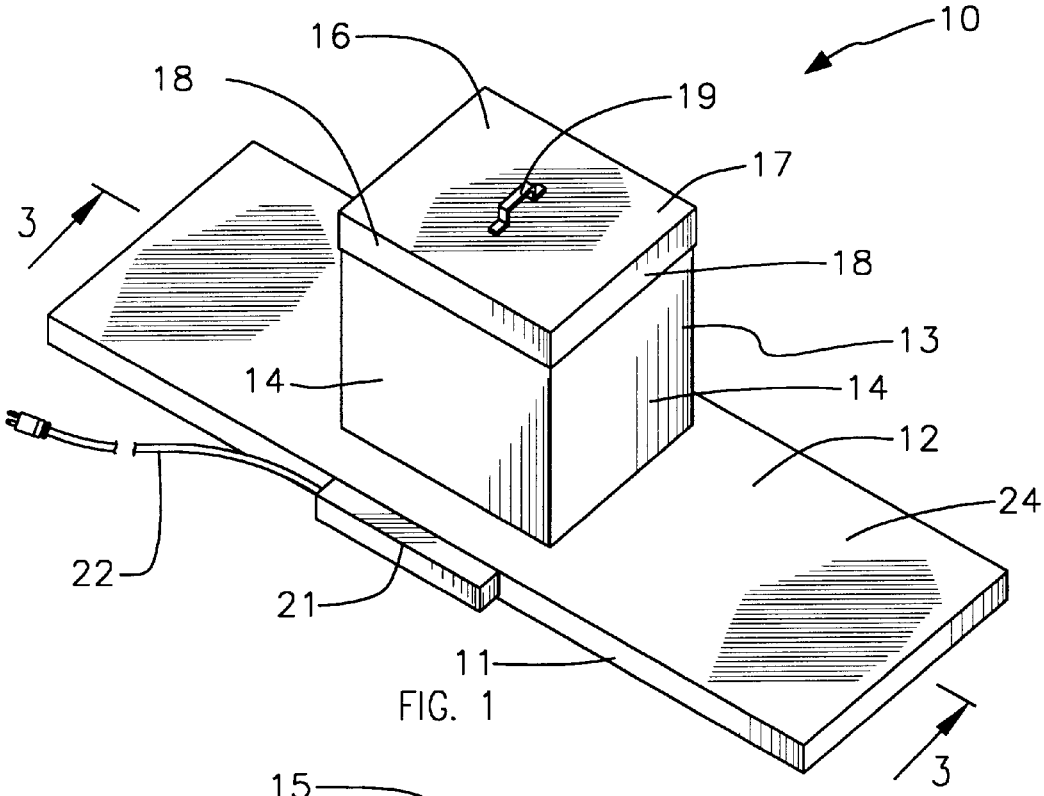
FIG. 1 is a top perspective view of a new substance holding and heating apparatus according to the present invention.
Figure 2:
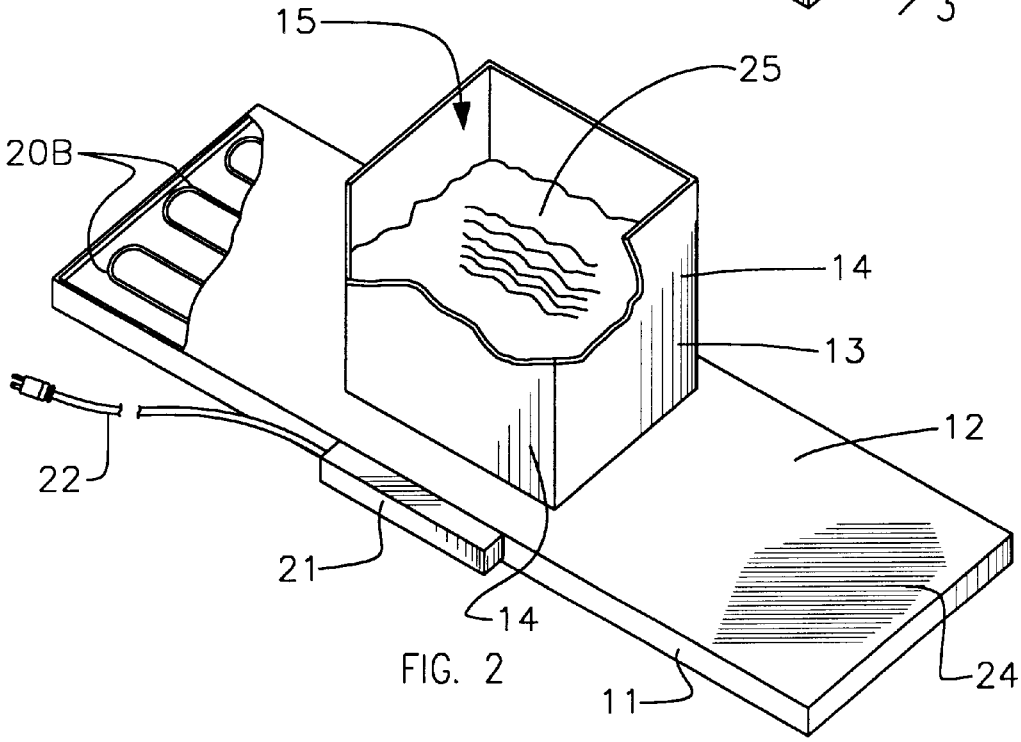
FIG. 2 is a partial breakaway perspective view of the present invention.
Figure 3:
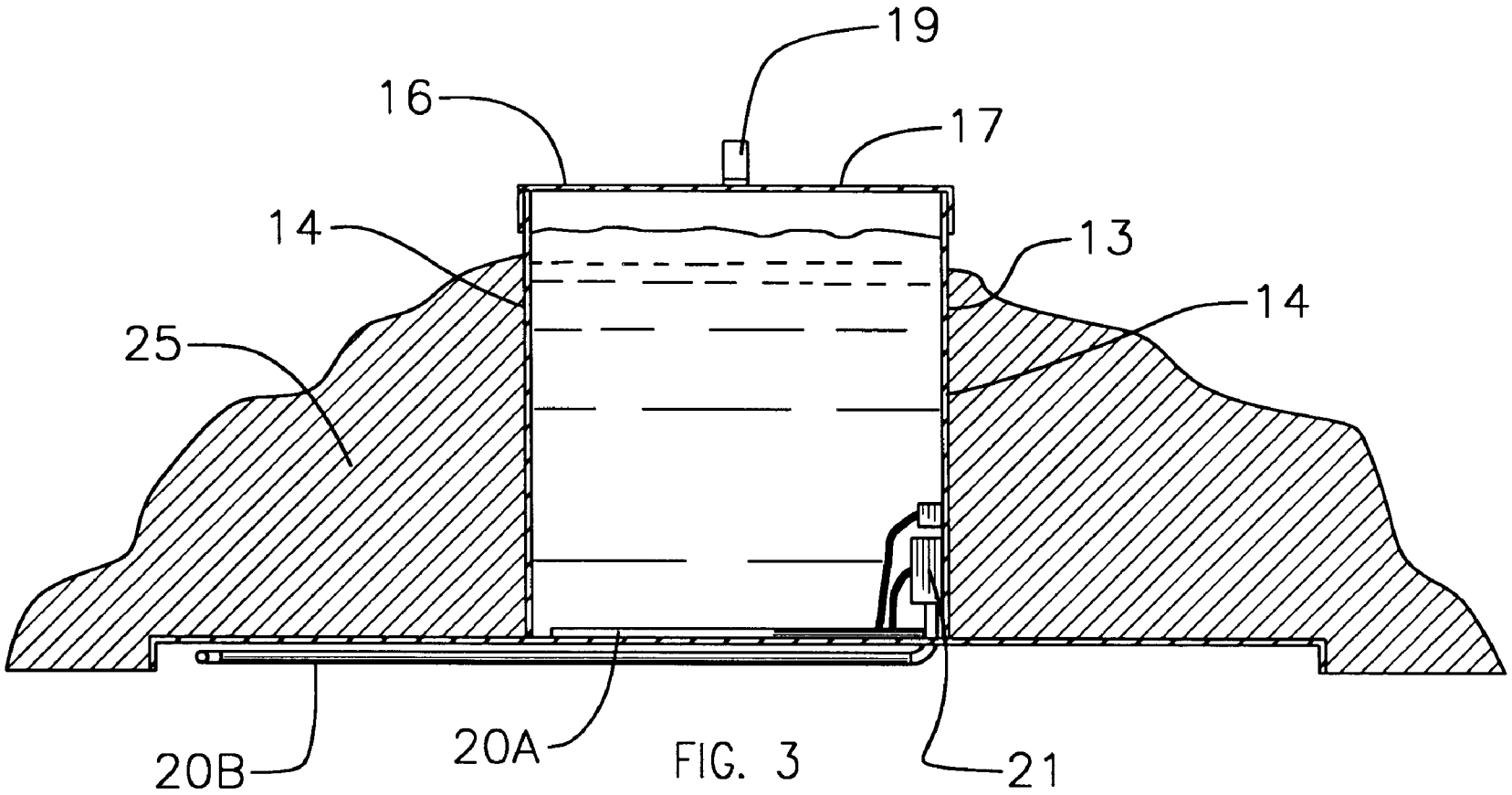
FIG. 3 is a side cross-sectional view of the present invention.
Figure 4:
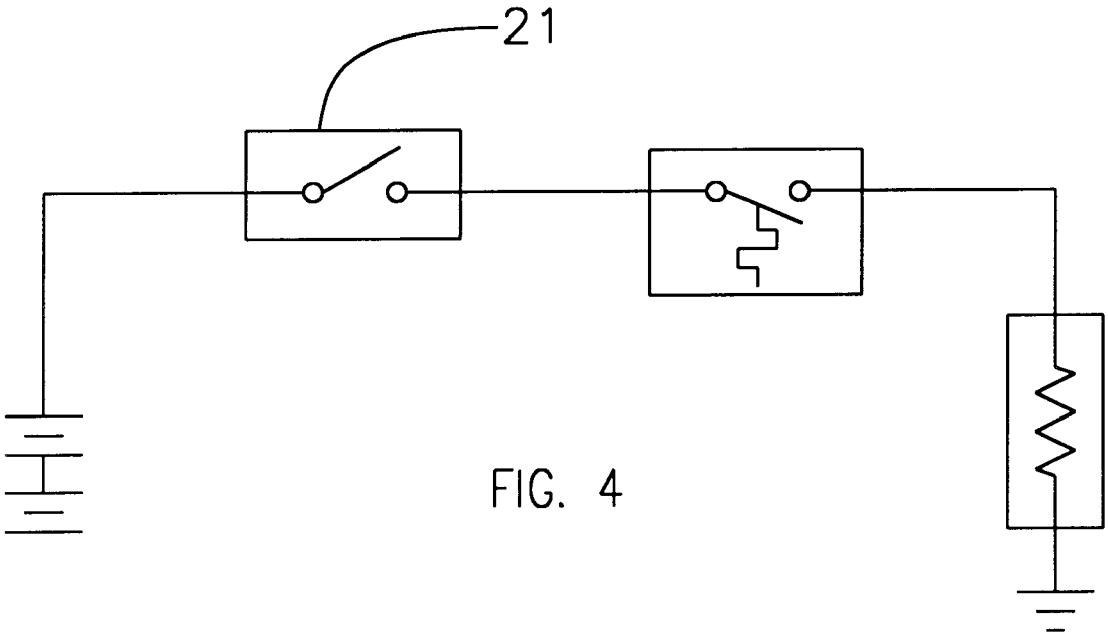
FIG. 4 is a schematic view of the present invention.

With reference now to the drawings, and in particular to FIGS. 1 through 4 thereof, a new substance holding and heating apparatus embodying the principles and concepts of the present invention and generally designated by the reference numeral 10 will be described.

As best illustrated in FIGS. 1 through 4, the substance holding and heating apparatus 10 generally comprises a base member 11 including a housing 12 having a top wall 24 with the base member 11 being essentially a thin, elongate rectangular structure. A substance holding member 13 is securely and conventionally disposed upon the top wall 24 and extends upwardly from the base member 11 and has side walls 14 and an open top 15. The substance holding member 13 is essentially a tank capable of receiving and storing substances 25 inside thereof between the side walls 14 with the housing 12 and the tank 13 being made of stainless steel. A lid member 16 is closeable over the open top 15 with the lid member 16 including a top wall 17 and side walls 18 extending downwardly from edges of the top wall 17, and further including a handle member 19 securely and conventionally attached to an exterior of the top wall 17. A means for heating a substance 25 contained in the substance holding member 13 includes a first heating member 20A and a second heating member 20B disposed inside of the housing 12 beneath the substance holding member 13, and also includes a conventional switch member 21 conventionally connected to the heating element 20, and further includes an electrical cord 22 conventionally connected to the switch member 21 and being adapted to plug into a power source for energizing the heating elements 20A and 20B.

In use, the user would use this apparatus especially during the cold doing masonry work handling water and sand in order to be able to mix the water and sand together. The user would plug the electrical cord 22 into a power source which would energize the heating elements 20A and 20B located in the housing 11 and would put sand and water in the tank 13 which is heated by the heating elements 20A and 20B to prevent the sand and water from freezing so that the sand and water can be effectively mixed to form mortar 25.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A substance heating and holding apparatus comprising:

a base member including a housing having a heat conductive top wall with an upper surface;

a substance holding member for holding a first substance to be heated, said substance holding member being inseparably mounted on said top wall and extending upwardly from said base member and having side walls and an open top, said substance holding member covering a portion of said upper surface of said top wall with a remainder portion of said upper surface being exposed for permitting a second substance to be placed thereon;

a lid member closeable over said open top; and a means for heating a substance contained in said substance holding member, said means for heating comprising a first heating member being located above said upper surface of said top wall between said side walls of said substance holding member for heating said first substance held in said substance holding member and a second heating member located below said top wall for heating said remainder portion of said top wall and said second substance resting on said upper surface.

2. A substance heating and holding apparatus as described in claim 1, wherein said base member is essentially a thin, elongate rectangular structure.

3. A substance heating and holding apparatus as described in claim 1, wherein said substance holding member is essentially a tank capable of receiving and storing substances inside thereof between said side walls.

4. A substance heating and holding apparatus as described in claim 1, wherein said lid member includes a top wall and side walls extending downwardly from edges of said top wall, and further includes a handle member securely attached to an exterior of said top wall.

5. A substance heating and holding apparatus as described in claim 1, wherein said means for heating a substance includes an electrical cord connected to a switch and being adapted to plug into a power source for energizing said heating members.

6. A substance heating and holding apparatus comprising:

a base member including a housing having a top wall, said base member being essentially a thin, elongate rectangular structure;

a substance holding member securely disposed upon said top wall and extending upwardly from said base member and having side walls and an open top, said substance holding member being essentially a tank capable of receiving and storing substances inside thereof between said side walls, said housing and said tank being made of stainless steel;

a lid member closeable over said open top, said lid member including a top wall and side walls extending downwardly from edges of said top wall, and further including a handle member securely attached to an exterior of said top wall; and a means for heating a substance contained in said substance holding member including at least one heating element disposed inside of said housing beneath said substance holding member, and also including a switch member connected to said at least one heating element, and further including an electrical cord connected to said switch member and being adapted to plug into a power source for energizing said at least one heating element.

7. A substance heating and holding apparatus comprising:

a base member including a housing having a top wall;

a substance holding member securely disposed upon said top wall and extending upwardly from said base member and having side walls and an open top;

a lid member closeable over said open top; and a means for heating a substance contained in said substance holding member;

wherein said base member is essentially a thin, elongate rectangular structure;

wherein said substance holding member is essentially a tank capable of receiving and storing substances inside thereof between said side walls;

wherein said lid member includes a top wall and side walls extending downwardly from edges of said top wall, and further includes a handle member securely attached to an exterior of said top wall; and wherein said housing and said tank are made of stainless steel.

8. A substance heating and holding apparatus as described in claim 7, wherein said means for heating a substance includes at least one heating element disposed inside of said housing beneath said substance holding member, and also includes a switch member connected to said at least one heating element, and further includes an electrical cord connected to said switch member and being adapted to plug into a power source for energizing said at least one heating element.

* * * * *